US009702666B2

(12) United States Patent
Meyne, Jr.

(10) Patent No.: US 9,702,666 B2
(45) Date of Patent: Jul. 11, 2017

(54) RETRIEVABLE TARGET ASSEMBLY AND METHOD OF USING RETRIEVABLE TARGET ASSEMBLY

(71) Applicant: David R Meyne, Jr., Buffalo, NY (US)

(72) Inventor: David R Meyne, Jr., Buffalo, NY (US)

( * ) Notice: Subject to any disclaimer, the term of this patent is extended or adjusted under 35 U.S.C. 154(b) by 0 days.

(21) Appl. No.: 15/092,109

(22) Filed: Apr. 6, 2016

(65) Prior Publication Data

US 2016/0341526 A1 Nov. 24, 2016

Related U.S. Application Data

(60) Provisional application No. 62/143,700, filed on Apr. 6, 2015.

(51) Int. Cl.
*F41J 3/00* (2006.01)
*F41J 7/02* (2006.01)

(52) U.S. Cl.
CPC ..... *F41J 3/0004* (2013.01); *F41J 7/02* (2013.01); *F41J 3/00* (2013.01)

(58) Field of Classification Search
CPC ..... F41J 3/0004; F41J 3/00; F41J 7/02
USPC ..... 273/348, 359, 369, 370, 390–392, 403, 273/404, 406–408
See application file for complete search history.

(56) References Cited

U.S. PATENT DOCUMENTS 2,586,958 A * 2/1952 Keller ..... F41J 3/0004 273/406
2,838,309 A * 6/1958 Merz ..... F41J 7/02 273/406
3,471,153 A * 10/1969 Baumler ..... F41J 9/02 273/359
3,949,730 A 4/1976 Schoenberger
5,577,734 A * 11/1996 Conroy ..... F41J 13/00 273/407
5,775,698 A * 7/1998 Jones ..... F41J 9/02 273/359
7,946,588 B1 * 5/2011 Hockman ..... F41J 3/00 273/406
8,074,994 B1 * 12/2011 Delphia ..... F41J 3/00 211/119.02
8,991,063 B2 3/2015 Eckhart
2008/0227559 A1 * 9/2008 Geary ..... A63H 33/18 473/196
2008/0254693 A1 * 10/2008 Zogg ..... B63C 9/08 441/84

(Continued)

*Primary Examiner* — Mark Graham
(74) *Attorney, Agent, or Firm* — Del Vecchio and Stadler LLP

(57) ABSTRACT

A retrievable target assembly is provided that comprises a retrievable target and a string. The retrievable target includes a pyramid shaped portion from which extends an enlarged portion. The pyramid shaped portion includes a vertex portion and the string has a pulling end and a connecting end and the connecting end is secured to the vertex portion. The user throws the retrievable target in any desired direction and as far as desired. Then the user tugs on the string such that the vertex portion faces the user. The user shoots arrows into the retrievable target and when done, pulls the string to return the retrievable target so that the arrows can be removed from the target. The user removes the arrows and repeats the process again. The user may be sitting, standing, or standing in a tree stand. The retrievable target is differently shaped in other preferred embodiments.

3 Claims, 8 Drawing Sheets

(56) References Cited

U.S. PATENT DOCUMENTS

| | | | | |
|---|---|---|---|---|
| 2011/0031695 | A1* | 2/2011 | Gibson | F41J 9/02 273/359 |
| 2011/0260404 | A1 | 10/2011 | LaPorte | |
| 2013/0061820 | A1 | 3/2013 | Earl | |
| 2013/0154191 | A1 | 6/2013 | LaPorte | |
| 2014/0054859 | A1 | 2/2014 | Kantor | |
| 2014/0256479 | A1* | 9/2014 | Bynum, Jr. | F42B 6/08 473/470 |

* cited by examiner

RETRIEVABLE TARGET ASSEMBLY AND METHOD OF USING RETRIEVABLE TARGET ASSEMBLY

CROSS REFERENCE TO RELATED APPLICATION

This application claims the benefit of U.S. Provisional Application No. 62/143,700 filed on Apr. 6, 2015 the entire disclose and contents of which are hereby incorporated herein by reference.

BACKGROUND

Target practice is essential for many outdoor and recreational activities. For example, in the field of archery it is very important that when the hunter places his or sights on an animal the arrow hits its mark every time. This prevents animals from being injured, but not killed, by a poorly shot arrow. The more practice an archer has with his bow and arrows, the more true his or her aim will be and consequently the likelihood of a poorly shot arrow is greatly decreased.

In addition, in there are many archers that compete in competitions. For these individuals their shots must be perfect or almost perfect every time. Of course, to be successful in competition archery the archer must continuously practice to hone his or her skills to the highest level possible.

Thus, practice is key to the success of anyone shooting arrows, regardless of what type or activity the shooter is involved with. Practice is essential regardless of whether the or not the person is using a compound bow, a recurve bow, a cross bow or other type of bow.

One of the problems hunters and competition archers encounter is that they are unable to practice for a extended amounts of time. When practicing every time the arrows are shot into a target they must be retrieved, which causes the shooter to have to physically walk to the target and retrieve the arrows. This takes time, breaks concentration, and if the ground is muddy, wet, snow or ice covered, or rugged it takes much of the fun out of practicing. Indeed, if the target is, for example thirty (30) yards away the walk to retrieve the arrows can become a time consuming and exhausting and this discourages practice.

Practicing becomes even more difficult if the hunter and practicing from a tree stand. The hunter must continuously go up and down his or her tree stand ladder to retrieve the arrows used in practice. This is not only exhausting, but can become quite dangerous as tree stands are difficult to get into and out of and many are very stable and are not designed to withstand such use.

The above is also true for hunters and target shooters that use firearms instead of bows and arrows. They too must practice, but are often discouraged from doing so because they must deal with many of the same issues regarding practicing that archers face.

Thus, what is needed is a product that is easy to use, inexpensive, and allows hunters, recreational shooters and competition shooter to practice for as long as they wants that avoids and ends or greatly reduces the problems associated target practice.

SUMMARY

A retrievable target assembly is provided that comprises a retrievable target and a string. The retrievable target includes a pyramid shaped portion from which extends an enlarged portion. The pyramid shaped portion includes a vertex portion and the string has a pulling end and a connecting end and the connecting end is secured to the vertex portion.

The user throws the retrievable target in any desired direction and as far as he or she wants. Then the user tugs on the string such that the vertex portion faces the user. The user is now facing one of the flat sides of the pyramid shaped portion.

The user shoots arrows into the retrievable target and when done, pulls the sting to return the retrievable target to the users feet. The user removes the arrows and repeats the process again and again. The user can also be sitting in a tree stand while practicing in this manner.

In other preferred embodiments the retrievable target can be made in other shapes, for example the retrievable target may be in the shape of an animal or creature including, but not limited to, small mammals of all kind and type, birds, large animals and reptiles of all kind and type, and objects have different geometric shapes such as squares, cylinders, cones, truncated cones, or virtually any desired geometric shape. Each of these retrievable targets would be attached to the string.

In addition, the target assembly can be used by a plurality of different users shooting different projectiles. Thus, in addition for use with arrows, users can also utilize the target assembly for target practice when shooting bullets from guns and other firearms in order to hone their skills.

BRIEF DESCRIPTION OF THE DRAWING FIGURES

DESCRIPTION

Figure 1:
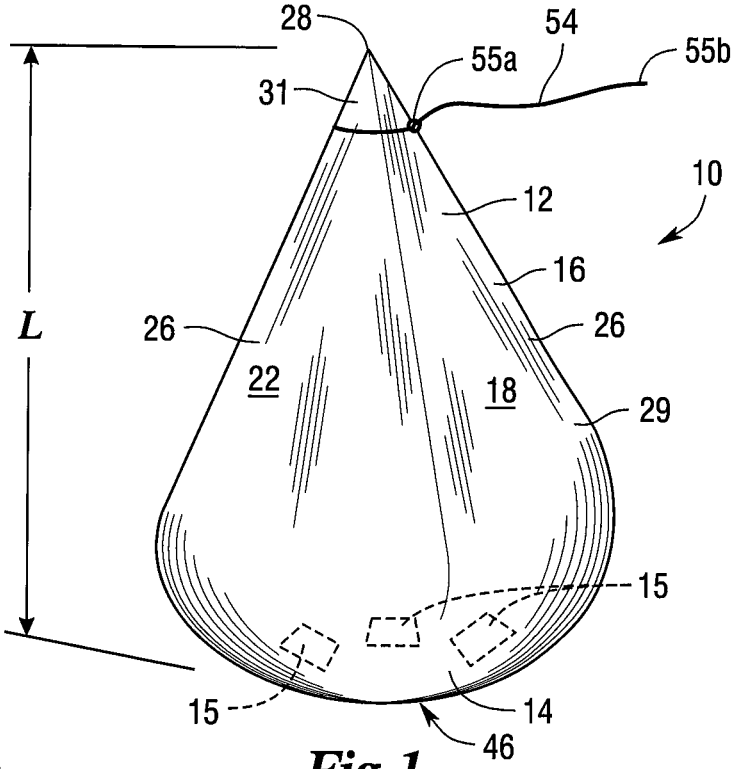
FIG. 1 is a perspective view of a retrievable target assembly.
Figure 2:
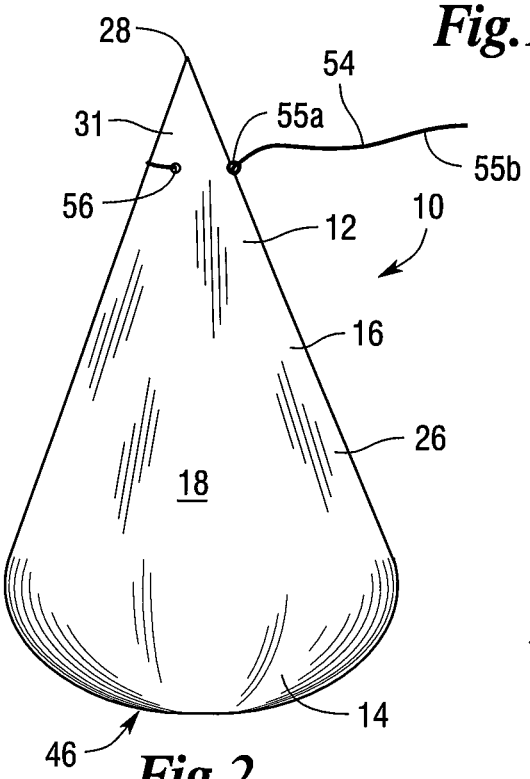
FIG. 2 is a front view of the retrievable target assembly.
Figure 3:
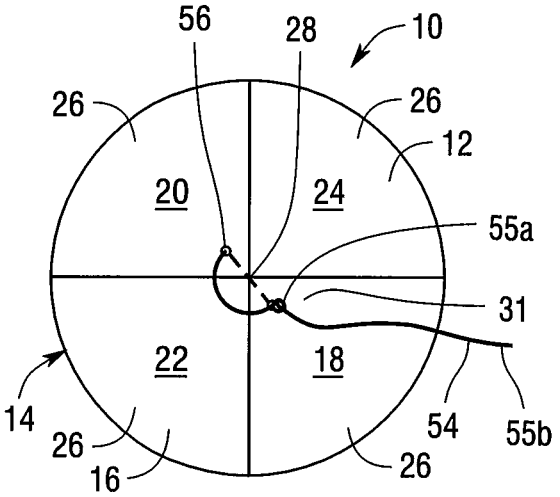
FIG. 3 is a top view of the retrievable target assembly.

As shown in FIGS. 1-3 there is retrievable target assembly 8 that includes a retrievable target 10. The retrievable target 10 has pyramid shaped portion 12 that meets with an enlarged portion 14. In one of the preferred embodiments the pyramid shaped portion 12 and the enlarged portion 14 are formed as a one-piece body 16, such that the pyramid shaped portion 12 extends from the enlarged portion 14. As shown in FIG. 3, the pyramid shaped portion 12 has opposed first and second surfaces 18, 20, and opposed third and fourth surfaces 22, 24. The opposed first and second surfaces 18, 20, and opposed third and fourth surfaces 22, 24 are flat or may be substantially flat and each has a triangle shape commonly designated 26. In one of the preferred embodiments the triangular shape 26 is in the form of an isosceles triangle, but may be in the form of an equilateral triangle in other preferred embodiments. The opposed first and second surfaces 18, 20, and opposed third and fourth surfaces 22, 24 all meet at a vertex 28 such that the pyramid shaped portion 12 has a vertex portion 31.

Figure 2B:
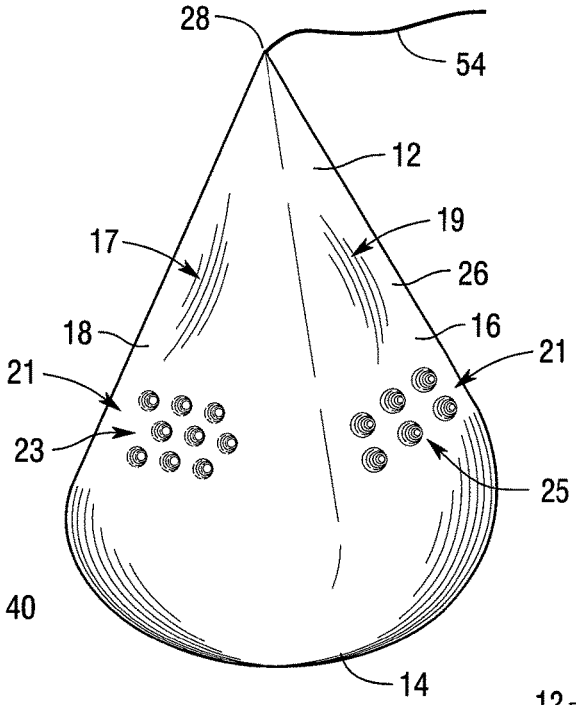
FIG. 2B is a front view of the retrievable target assembly having a retrievable target with surfaces that are not flat.

As shown in FIG. 2B, in other preferred embodiments the first and second surfaces 18, 20, and opposed third and fourth surfaces 22, 24 and be embodied to have concave 17 or convex surfaces 19, or can be embodied to have different textured surfaces 21, for example dimples 23 or protrusions 25 or other surface patterns as shown in FIG. 2B, instead of being flat as described above.

Figure 4:
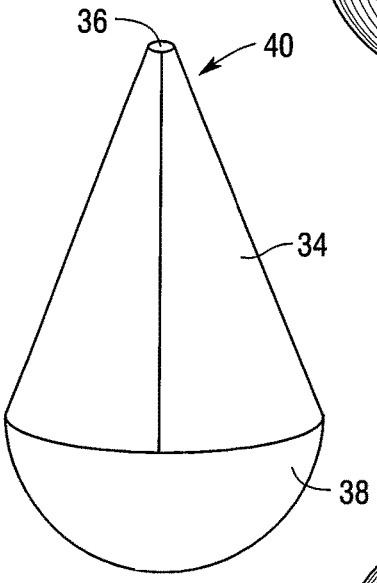
FIG. 4 is a front view of a mold for forming a retrievable target.
Figure 5:
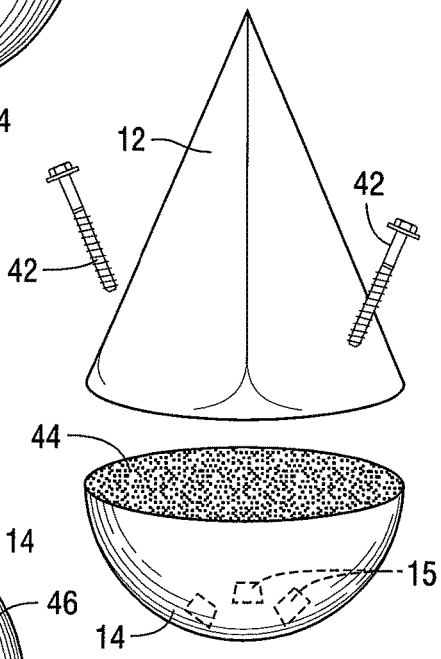
FIG. 5 is a front view of a two-piece mold for forming the retrievable target.

As mentioned above the pyramid shaped portion 12 and enlarged portion 14 are formed as a one-piece body 16 in one of the preferred embodiments made of polyurethane foam 29 that is hard, and in other preferred embodiments can be made of foam, polyethylene foam, wood, laminates, rubber, polystyrene foam, fibrous materials, polyester materials, fabrics, and other suitable materials capable of withstanding the impact of an arrow 30 shot from a bow 32. In one of the preferred embodiments the retrievable target 10 is solid and made from the above-describe materials. In other preferred embodiments a mold 34 (FIG. 4) can be made in the shape of the retrievable target 10 and the mold 34 has a fill opening 36 and a removable enlarged portion cap 38 and expandable foam 40 is introduced into the mold 34 through the fill opening 36 as shown. After the expandable foam 40 expands and cures in the mold 34, the mold 34 the enlarged cap portion 38 is removed and the retrievable target 10 is removed from the mold 34. Expandable foams are well known to those having ordinary skill in the art. In other preferred embodiments and as shown in FIG. 5, the pyramid shaped portion 12 and the enlarged portion 14 can be formed separately from one another and connected with, for example, fasteners such as screws or nails commonly designated 42 or adhesives and waterproof adhesives commonly designated 44 or a combination of both, or the pyramid shaped portion 12 and the enlarged portion 14 can be melted together if they are made of foam or plastic. In addition, the pyramid shaped portion 12 and the enlarged portion 14 can be made of the same or different materials in such an embodiment.

In another preferred embodiment there are the pyramid shaped portion 12 and the enlarged portion 14 that are formed separately and weights 15 (shown in dashed lines in FIGS. 1 and 5) are added to the enlarged portion. The weights 15 may be in the form of steel or lead weights 15 and be disposed internal to the enlarged portion 14 or can be attached or adhered with an adhesive to the enlarged portion 14. The weights 15 allow the user 100 to throw the retrievable target 10 farther and provide for added stability while traveling in the air, and the weights 15 will stabilize the retrievable target 10 when the retrievable target 10 is shot with arrows 30. As shown in FIG. 5, the pyramid shaped portion 12 and the enlarged portion 14 with weights 15 can be formed separately from one another and connected with, for example, fasteners such as screws or nails commonly designated 42 or adhesives and waterproof adhesives commonly designated 44.

In another preferred embodiment the retrievable target 10 is cut from a block of material, for example a block of polyurethane foam 29, foams, polyethylene foam, wood, laminates, rubber, polystyrene foam, fibrous materials, polyester materials, fabrics, and other suitable materials. This reduces the time required to fabricate the retrievable target 10.

Figure 6:
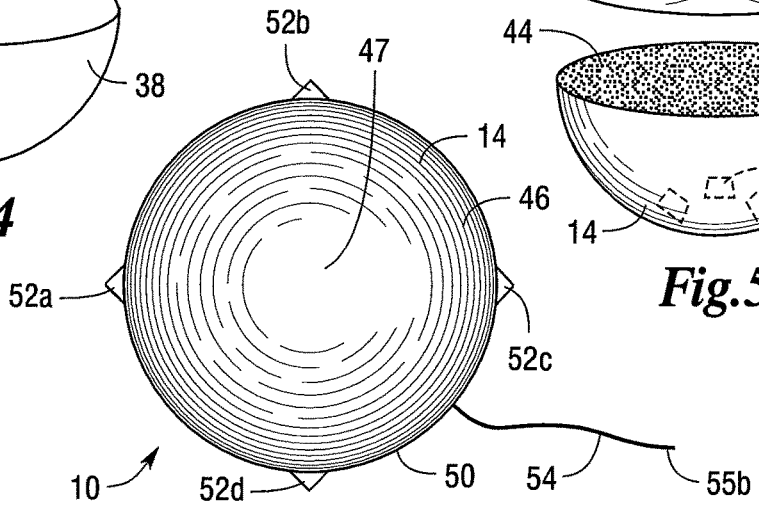
FIG. 6 is a bottom view of the retrievable target assembly.

As shown in FIGS. 1, 2 and 6, there is a bottom view of the retrievable target 10 showing the enlarged portion 14. The enlarged portion 14 has a convex surface 46 that extends in a direction away from the pyramid shaped portion 12. The enlarged portion 14 has distal end 47 that is opposite the vertex 28. In one of the preferred embodiments the convex surface 46 is smooth. The enlarged portion 14 has a periphery 50 where it merges with the pyramid shaped portion 12 as shown in FIG. 6. The opposed first and second surfaces 18, 20, and opposed third and fourth surfaces 22, 24 can be sized such that will not be visible in the bottom view, that is, they are flush or substantially flush where they meet with the enlarged portion 14 as shown in FIG. 3. Alternatively, as shown in FIG. 6, there are first, second, third and fourth corner portions 52*a*, 52*b*, 52*c* and 52*d*, respectively. The first, second, third and fourth corner portions 52*a*, 52*b*, 52*c* and 52*d* that may be formed during manufacture of the retrievable target 10. The first, second, third and fourth corner portions 52*a*, 52*b*, 52*c* and 52*d* and protrude beyond the enlarged portion 14 where the first surface 18 meets the fourth surface 24, and the fourth surface 24 meets the second surface 20, and the second 20 meets the third surface 22, and the third surface 22 meets the first surface 18, respectively.

The retrievable target 10 weighs from about two pounds in one of the preferred embodiments and may weigh from more or less than two pounds to about five pounds in other preferred embodiments. The target 10 may be lighter or heavier in other preferred embodiments. The retrievable target 10 his a length designate L in FIG. 1 of about thirteen inches long as measured from the vertex 28 to the distal end 47, but may be more or less than thirteen inches long, for example, it may be about eighteen to twenty six inches long in other preferred embodiments. In other preferred embodiments the retrievable target 10 is hollow, in which case the opposed first and second surfaces 18, 20, and opposed third and fourth surfaces 22, 24 and convex surface 46 are constructed as walls instead of surfaces.

The retrievable target assembly 8 further includes a string 54 that is secured to the target 10, and the string has a connecting end 55*a* and a pull end 55*b*.

The term string 54 as used herein and in the appended claims includes rope, plastic cord, cable, parachute cord and other suitable types of string-like cords and equivalents thereof.

The string 54 can have virtually any length and may be, for example, thirty yards long. The string 54 is secured to the vertex portion 31 of the retrievable target 10. As shown in FIG. 2, the string 54 may be secured to the vertex portion 31 with a knot formed in the string 54 that surrounds the vertex portion 31. In addition, as shown in FIG. 1, in another preferred embodiment the vertex portion 31 defines a vertex opening 56 and the string 54 can be extended through the vertex opening 56 and thus tied to the retrievable target 10 with a knot. And, in the embodiment described above where the retrievable target 10 is formed in a mold 34 with expandable foam 40, the connecting end 55*a* of the string the string 54 is placed in the mold 34 prior to introduction of the expandable foam 40. The remainder of the string 54 extends out of the fill opening 36. After introduction of the expandable foam 48 (and curing of same) the string 54 is permanently secured to the retrievable target 12 as shown in FIG. 3. In other preferred embodiments a carabineer can be extended through the vertex opening 56 and the string 54 is tied to the carabineer. Adhesives 44 may also be used to secure the string 54 to the vertex portion 31. Thus, the string 54 can be secured to the vertex portion 31 in a plurality of different ways.

Figure 7A:
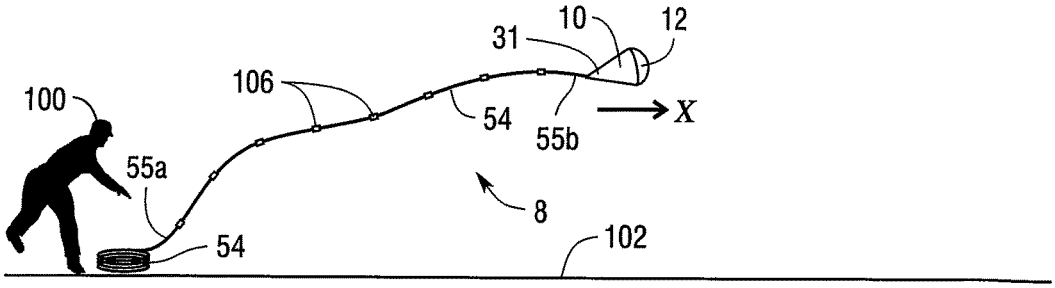
FIGS. 7A-7D are views of the retrievable target assembly in use.
Figure 7B:
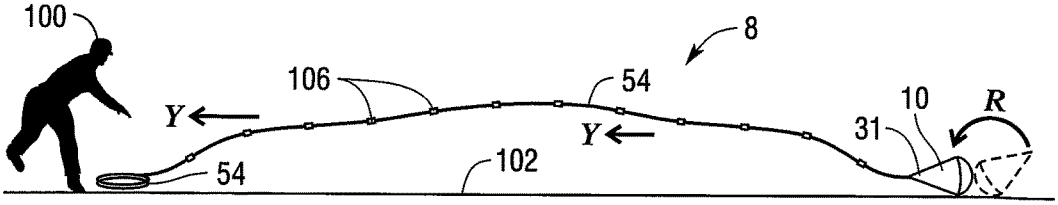
Figure 7C:
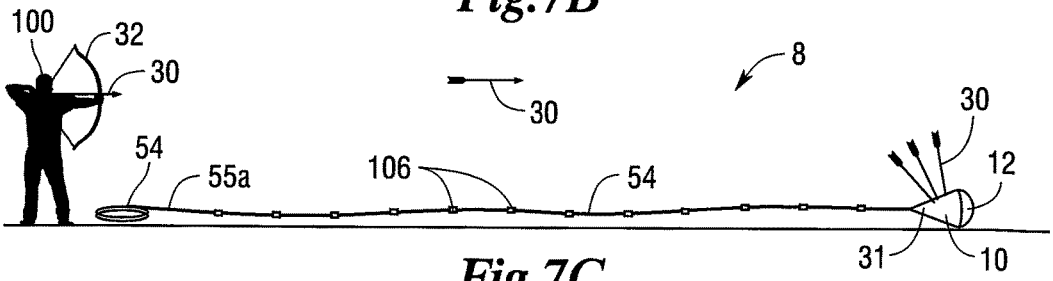
Figure 7D:
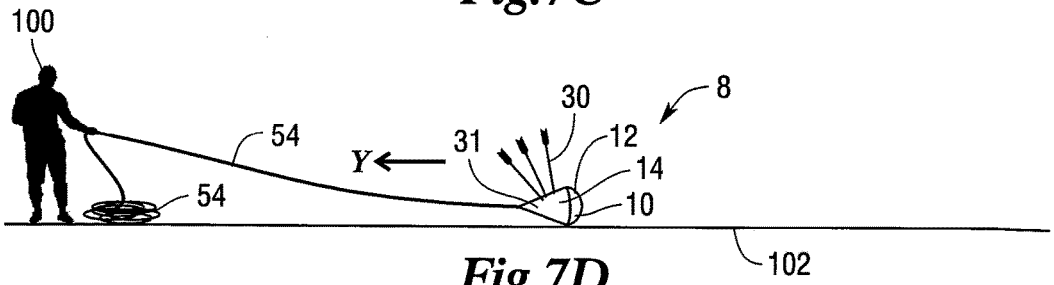
Figure 8:
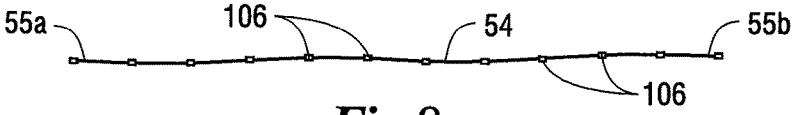
FIG. 8 is a string for use in the retrievable target assembly having printed indicia.

In use, the retrievable target assembly 8 allows the user 100 (users include hunters, archers, recreational and competition shooters) to practice shooting quickly and repeatedly without ever having to move from the spot where he or she is standing or sitting. As shown in FIG. 7A there is a user 100 on standing on the ground 102. The user 100 has thrown the retrievable target 10 and it is in air and moving in a direction away from the user 100 as indicated by the arrows designated X. In FIG. 7B the retrievable target 10 has hit the ground 102, but the vertex portion 31 does not point directly at the user 100. The user 100 pulls on the string 54 in the direction of the arrow designated Y, and this causes the retrievable target 10 to rotate (as indicated by the arrow designated R in FIG. 7B) such that the pyramid shaped portion 12 of the retrievable target 10 faces the user 100. This ensures that the user 100 will have a one of the opposed first and second surfaces 18, 20, and opposed third and fourth surfaces 22, 24 to aim at. As previously mentioned, these are flat thus provide the user 100 with a flat surface to shoot at and hit with the arrow 30. It is pointed out that curved surfaces and round surfaces are sometimes problematic less experienced users 100, because their arrows 30 are often improperly or poorly shot thus causing the arrows 30 to deflect off such surfaces. The retrievable target 10 is well suited for all users 100 regardless of their skill or experience level. If FIG. 7C the user 100 is shown successfully delivering arrows 30 into the retrievable target 10 and they are not deflected. As shown in FIG. 7D, after the user 100 is finished shooting the arrows 30 he or she grasps the string 54 and pulls the string 54 in back to him or herself in the direction of the arrows designated Y. The user 100 then removes the arrows 30 from the retrievable target 10 and repeats the above-described process. The user 100 does not need to walk to the retrievable target and thus avoids having to walk on mud, snow, ice and the like to practice.

As shown in FIGS. 7A-7D and FIG. 8 the string 54 may be embodied to have printed indicia 106 in the form of feet or yard distances that are marked and numbered at every foot or every yard on the string 54, such that the user 100 does not have to guess at how far away the retrievable target 10 is from him or her. This also allows the user 100 to throw the retrievable target 10 at virtually any desired distance so that he or she can hone his or her skills at a particular distance.

Figure 9:
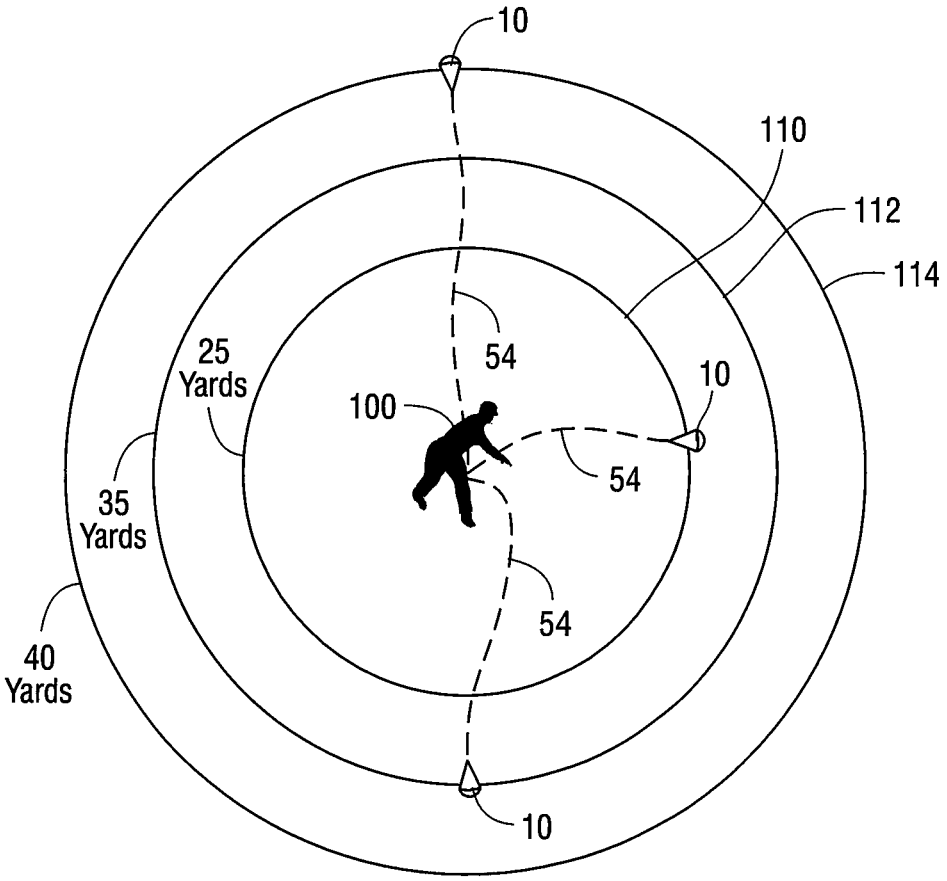
FIG. 9 is view of the retrievable target assembly in use by an archer.
Figure 10:
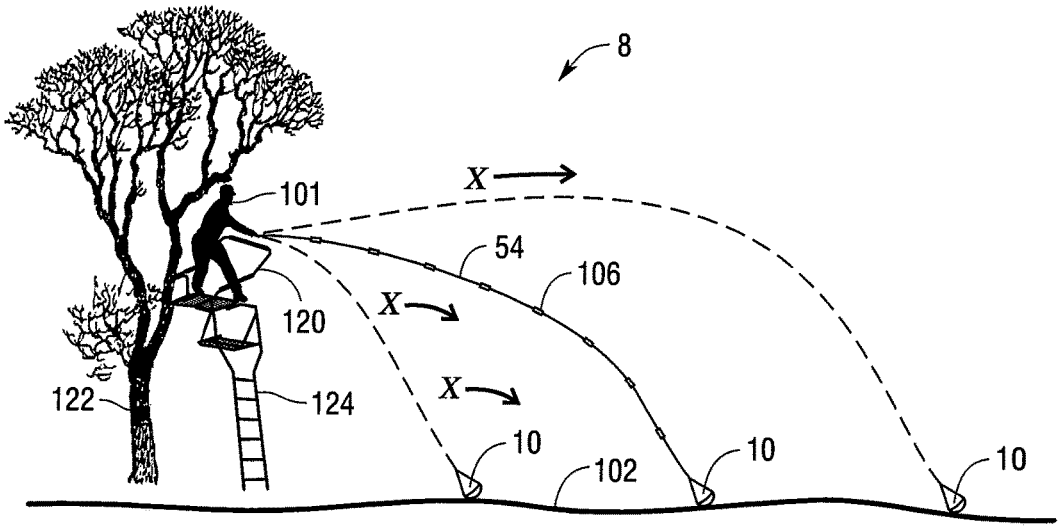
FIGS. 10-13 are views of the retrievable target assembly in use by a hunter in a tree stand.

In addition, as shown in FIG. 9 the user 100 is free to throw the retrievable target 10 in any direction he or she desires because the retrievable target 10 can be thrown in virtually any direction. In other words, the user 100 can throw the retrievable target 10 anywhere within in a three hundred and sixty degree circle from where the user 100 is standing (with the user 100 standing at the center of the circles designated 110, 112, 114. The user 100 is shown throwing the retrievable target 10 out to twenty-five yards, thirty-yards and forty-yards in any desired direction. The string 54 is shown in dashed line. The user 100 can thus practice a virtually limitless number of shooting distance scenarios without having to walk and pull arrows out of a fixed target.

Figure 11:
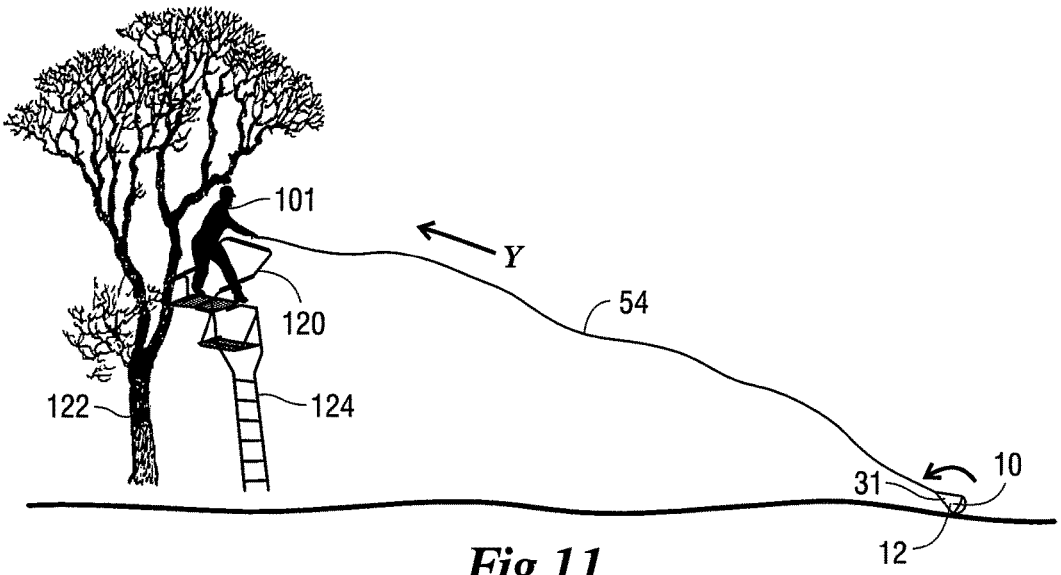
Figure 12:
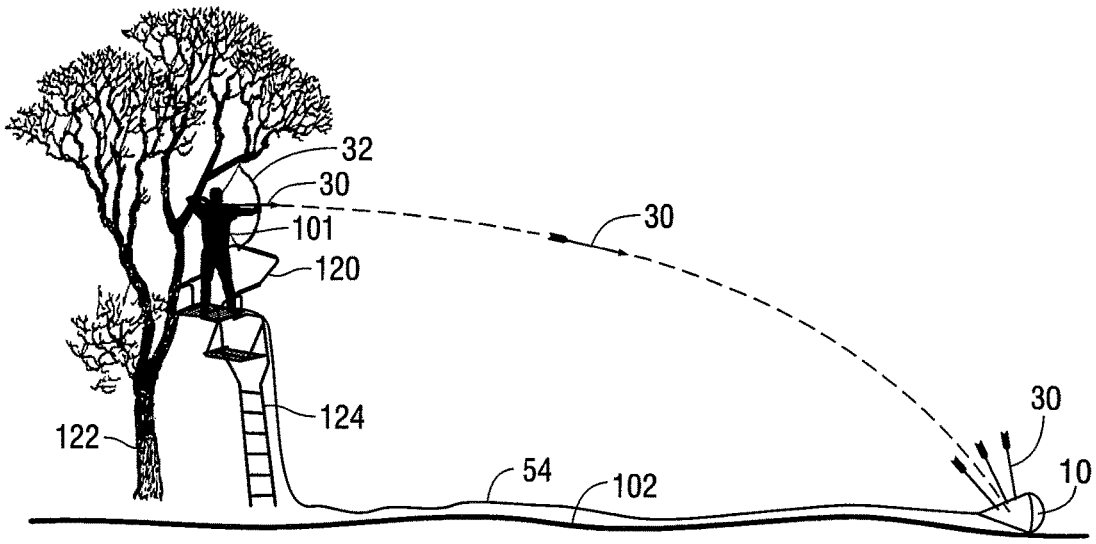
Figure 13:
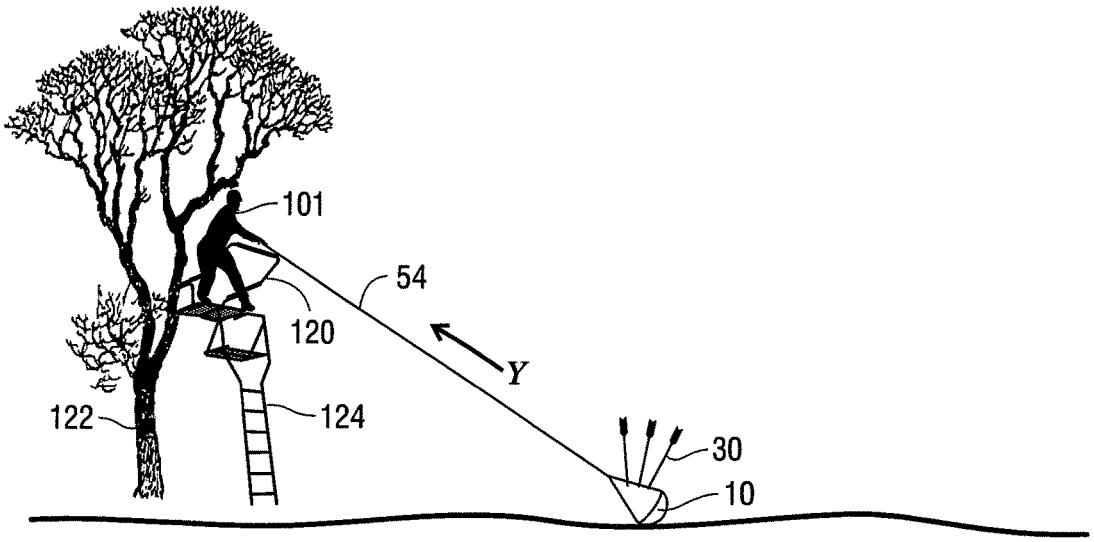

In addition, as shown in FIG. 10-13 there is a user 100 that is a hunter in a tree stand 120 secured to a tree 122 which is and accessible with a ladder 124. The user 100 is show throwing the retrievable target 10 at varying distances from the tree 122. In FIG. 11 the hunter 101 is shown pulling the string 24 so that the vertex portion 31 faces him or her. In FIG. 12, the user 100 shoots arrows 30 into the retrievable target 10, and in FIG. 13 the hunter 101 is shown pulling the retrievable target 10 in the direction of arrow Y. Thus, the user 100 can throw the retrievable target 10 to any desired distance and practice without out having to climb up and down the ladder 124 and without having secure and unsecure himself or herself from the tree stand 120. Climbing into and exiting tree stands 120 can be dangerous and the retrievable target assembly 8 virtually eliminates the hazards of repeatedly climbing into and out of tree stands 120. In addition, the string 54 may be used to assist the user 100 in determining how high off the ground 102 he or she is when in a tree stand, because the sting 54 has printed indicia 106 in the form of measurement markings.

It is also pointed out that the retrievable target assembly 8 allows the user 100 to change the distance from him or her to the retrievable target 10 while shooting. The user 100 pulls on the string 54 and draws the retrievable target 10 closer and can take another shot. This, the retrievable target 10 is movable while the user 100 is shooting arrows 30 providing the user 100 with enhanced target practice.

Figure 14:
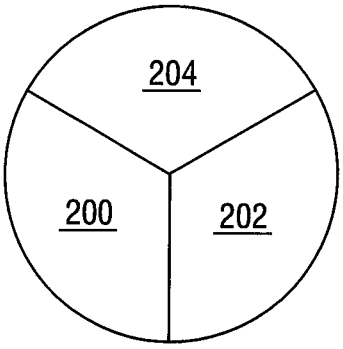
FIGS. 14 and 15 show a pyramid shaped portion having three surfaces.
Figure 15:
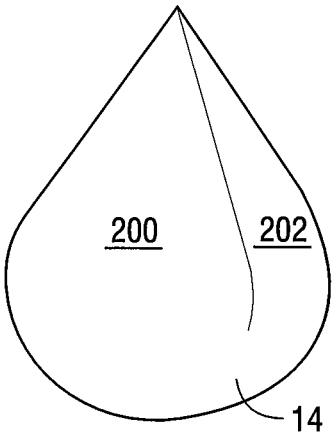
Figure 16:
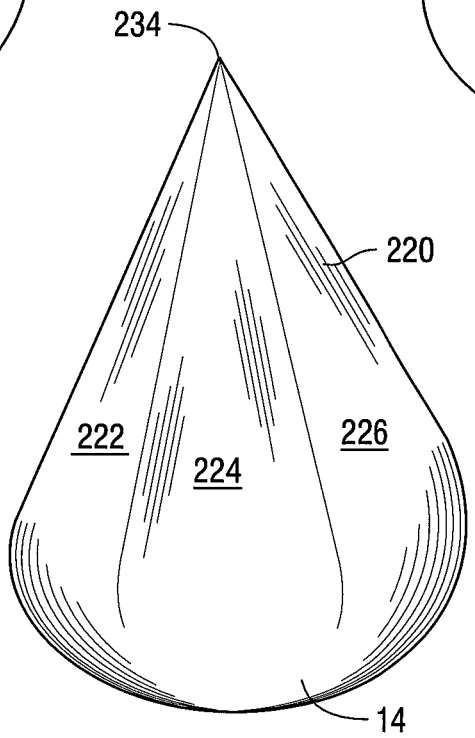
FIGS. 16 and 17 show a pyramid shaped portion having six surfaces.
Figure 17:
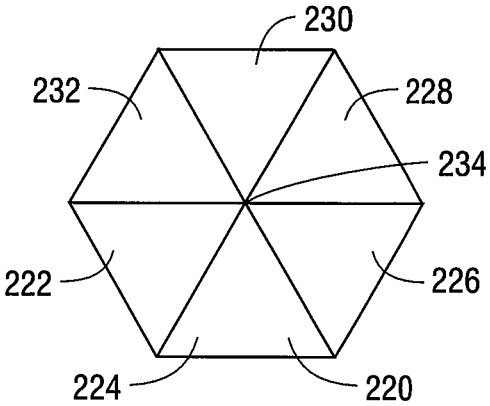

In other preferred embodiments as shown in FIGS. 14 and 15, the above described pyramid shaped portion 12 may be embodied triangular shaped portion 12*a* with three triangular surfaces commonly designated 200, 202, 204 that meet at a vertex 206 from which extends the enlarged portion 12. In another preferred embodiment shown in FIGS. 16 and 17 the pyramid shaped portion 12 maybe be embodied as a hexagonal shape portion 220 with six triangular shaped surfaces 222, 224, 226, 228, 230, 232 that meet at a vertex 234 and from which extends the enlarge portion 12. In other preferred embodiments the pyramid shaped portion can have five surfaces or more that six surfaces.

Figure 18:
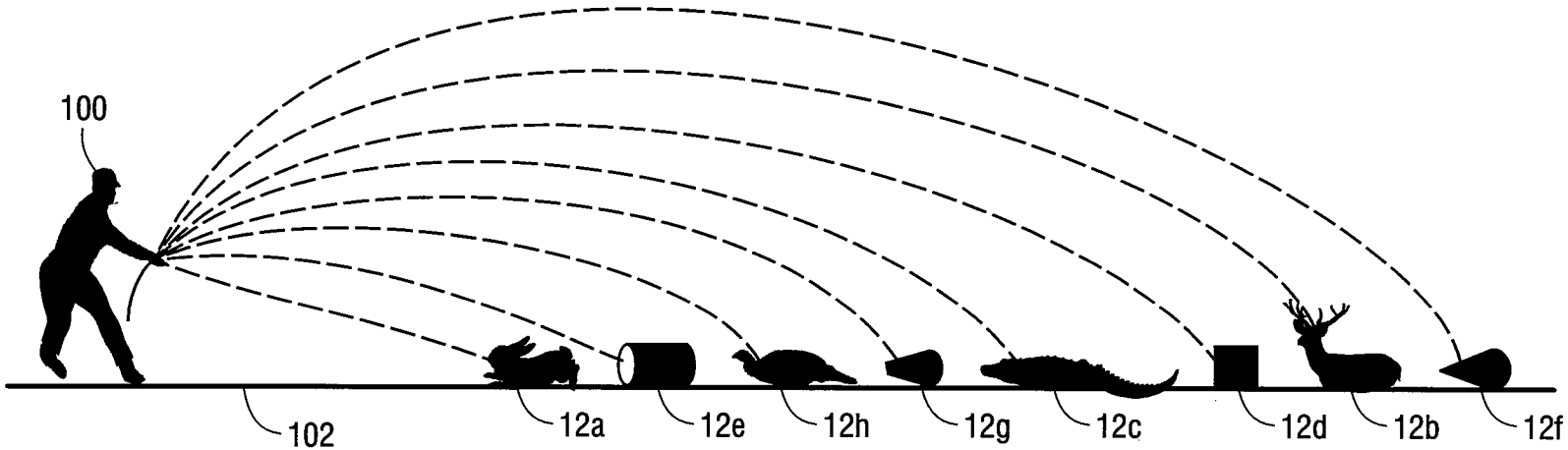
FIG. 18 is a view of a user shooting arrows at differently shaped retrievable targets.

As shown in FIG. 18, in other preferred embodiments the retrievable target 12 of can be otherwise formed and shaped as an animal or geometric object. For example the retrievable target 12 may be in the shape of an animal or creature including, but not limited to, small mammal shaped retrievable targets 12*a* of all kind and type, bird shaped retrievable targets 12*h*, large animal shaped retrievable targets 12*b* and reptile shaped retrievable targets 12*c* of all kind and type, and objects have different geometric shapes such as square shaped retrievable targets 12*d*, cylinder shaped retrievable targets 12*e*, cone shaped retrievable targets 12*f*, truncated cone shaped retrievable targets 12*g*. The user 100 is shown shooting at these targets. Each of these retrievable targets is attached or otherwise joined to the string 54 and constructed of the previously described materials.

In other preferred embodiments users 100 firing guns, rifles and pistols and revolvers, can use the retrievable target assembly 8. Users 100 throwing knives can also utilize the retrievable target assembly 8. That is, the retrievable target assembly 8 is not limited to use by archers and hunters using bows and arrows, but may be used by any user 100 that wants or needs to practice his or her shooting or throwing skills.

It will be appreciated by those skilled in the art that while a retrievable target assembly 8 has been described in connection with particular embodiments and examples, the retrievable target assembly 8 is not necessarily so limited and that other examples, uses, modifications, and departures from the embodiments, examples, and uses may be made without departing from the retrievable target assembly 8. All these embodiments are intended to be within the scope and spirit of the appended claims.

What is claimed:

1. A method of using a retrievable target assembly comprising the acts of:

providing a retrievable target assembly having a retrievable target and a string;

providing the retrievable target with a pyramid shaped portion having a vertex portion;

providing the retrievable target with an enlarged portion that meets with the pyramid shaped portion;

providing the string with a connecting end and a pulling end and connecting the connecting end of the string to the vertex portion;

throwing the retrievable target such that it lands on the ground;

pulling on the pulling end of the string such that the retrievable target is caused to rotate such that the vertex portion extends straight from the string;

shooting arrows into the pyramid shaped portion; and, pulling on the string such that upon its return the arrows can be removed from the retrievable target and the retrievable target can again be thrown.

2. The method of practicing archery shooting according to claim 1 further including providing the retrievable target enlarged portion with a convex surface.

3. The method of practicing archery shooting according to claim 1 further including providing a user and situating the use user in a tree stand and wherein the user shoots and retrieves while remaining in the tree stand.

* * * * *